US009200237B2

(12) United States Patent
Aoki et al.

(10) Patent No.: US 9,200,237 B2
(45) Date of Patent: Dec. 1, 2015

(54) 4,8-DIMETHYL-4,9-DECADIENENITRILE

(71) Applicant: Kao Corporation, Chuo-ku (JP)

(72) Inventors: Takashi Aoki, Wakayama (JP); Takahiro Hirose, Chiba (JP); Shoichi Tahara, Ichikawa (JP)

(73) Assignee: Kao Corporation, Chuo-ku (JP)

( * ) Notice: Subject to any disclaimer, the term of this patent is extended or adjusted under 35 U.S.C. 154(b) by 53 days.

(21) Appl. No.: 14/183,923

(22) Filed: Feb. 19, 2014

(65) Prior Publication Data

US 2014/0235519 A1 Aug. 21, 2014

(30) Foreign Application Priority Data

Feb. 21, 2013 (JP) ..... 2013-031651

(51) Int. Cl.
*C11D 3/50* (2006.01)
*C11B 9/00* (2006.01)

(52) U.S. Cl.
CPC ..... *C11B 9/0023* (2013.01)

(58) Field of Classification Search
CPC ..... C07C 255/07; C11B 9/023
USPC ..... 558/462
See application file for complete search history.

(56) References Cited

U.S. PATENT DOCUMENTS

| | | | | |
|---|---|---|---|---|
| 3,168,550 | A * | 2/1965 | Blumenthal | 558/430 |
| 2003/0153485 | A1 | 8/2003 | Markert et al. | |
| 2010/0204083 | A1 | 8/2010 | Weis et al. | |
| 2010/0279917 | A1 | 11/2010 | Mane et al. | |

FOREIGN PATENT DOCUMENTS

| | | |
|---|---|---|
| JP | 2003-532701 | 11/2003 |
| JP | 2010-534630 | 11/2010 |
| JP | 2011-506270 | 3/2011 |
| JP | 2012-505284 | 3/2012 |
| WO | 2010/044031 A1 | 4/2010 |

OTHER PUBLICATIONS

Motoichi Indo, "Synthetic perfume Product knowledge and the chemistry", Enlarged and Revised Edition Publication, Chemical Daily, Mar. 22, 2005, pp. 179-180 and 697-700 (with partial English translation).

* cited by examiner

*Primary Examiner* — John Hardee
(74) *Attorney, Agent, or Firm* — Oblon, McClelland, Maier & Neustadt, L.L.P.

(57) ABSTRACT

It is intended to provide a compound and a fragrance composition containing the compound, wherein the compound is useful as a fragrance, has floral and green odors in addition to a strong muguet odor, is stable in an aqueous vehicle, and can be blended with another fragrance to have enhanced freshness and diffusibility. It also is intended to provide 4,8-dimethyl-4,9-decadienenitrile and a fragrance composition containing 4,8-dimethyl-4,9-decadienenitrile.

20 Claims, No Drawings

4,8-DIMETHYL-4,9-DECADIENENITRILE

CROSS REFERENCES TO RELATED APPLICATIONS

This application claims priority to Japanese Patent Application No. 2013-031651, filed on Feb. 21, 2013.

FIELD OF THE INVENTION

The present invention relates to a new 4,8-dimethyl-4,9-decadienenitrile and a fragrance composition containing the same.

BACKGROUND OF THE INVENTION

Fragrance is an important element that creates, for example, preference, a sense of luxury, a sense of ease, and expectations for the effect for products, and the like. Furthermore, a distinctive fragrance provides a product differentiation effect and the capacity for attracting customers. On the other hand, in order to control, for example, a long-lasting property and balance of fragrance, generally, a fragrance is imparted to a product using a fragrance composition in which a plurality of fragrance materials are mixed together. It is required for the fragrance materials composing the fragrance composition to be highly harmonious with other fragrance materials.

With respect to the fragrance materials having unsaturated aliphatic nitrile structures, it is known that geranyl nitrile, which is 3,7-dimethyl-2,6-octadienenitrile, has a strong lemon/citral like odor, that Lemonile (Givaudan), which is 3,7-dimethyl-2,6-nonadienonitrile, has a fatty acid-like, warm, and powerful citrus-like odor, and that Mandaril (Symrise), which is 3,12-tridecadienenitrile, has a touch of refreshing orange peel with a fresh, cool, watery, and sweet tangerine note (Non-Patent Document 1).

In addition, Patent Document 1 describes that specific 3,5,7-trimethyloctane(octene)nitrile and a derivative thereof can be used as ingredients for perfume compositions.

Patent Document 2 describes that, for example, trimethyl octadienenitrile is useful as a fragrance component for imparting an olfactory note with a tone of lemon.

Patent Document 3 discloses a process for the preparation of ethylgeranonitrile by converting ethylheptenone with a deprotonated nitrile followed by hydrolysis and decarboxylation.

Patent Document 4 discloses specific trimethyldecene compounds with odor characteristics in which a tone of mandarin and a property similar to a fruit dominate.

Furthermore, it is known that Floral Super (IFF), which is 4,8-dimethyl-4,9-decadienal, has a strong green odor similar to that of vegetable leaves with a fruit-like odor (Non-Patent Document 1).

Very roughly speaking, fragrance materials have similar fragrances notes when they have similar structures to each other, but there are many exceptions. Particularly, when a plurality of substituents are combined to change the fragrance note, it is difficult to predict how the fragrance note will change and it also is difficult to predict the harmonicity with other fragrance materials.

PRIOR ART DOCUMENTS

Non-Patent Document

[Non-Patent Document 1] "Gosei Koryo, Kagaku to Shohin Chishiki" (Synthetic Perfumes, Chemistry and Commodity Knowledge), authored by Genichi Indo, Enlarged and Revised Edition, 2005, pp. 698-700 and 179-180.

Patent Documents

[Patent Document 1] JP 2011-506270 A
[Patent Document 2] JP 2012-505284 A
[Patent Document 3] JP 2010-534630 A
[Patent Document 4] JP 2003-532701 A

SUMMARY OF THE INVENTION

Therefore, with the foregoing in mind, it is an object of the present invention to provide 4,8-dimethyl-4,9-decadienenitrile.

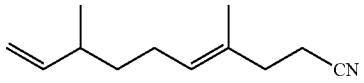

4,8-dimethyl-
4,9-decadienenitrile

DETAILED DESCRIPTION OF THE INVENTION

The present invention is intended to provide a compound and a fragrance composition containing the same, wherein (a) the compound has muguet, floral, and green odors, (b) it is stable in an aqueous vehicle, and (c) it can enhance freshness and diffusibility by being blended with another fragrance.

The present inventors found that 4,8-dimethyl-4,9-decadienenitrile had muguet, floral, and green odors, was stable in an aqueous vehicle, and was able to be blended with another fragrance to enhance freshness and diffusibility, which allowed the present invention to be completed.

In other words, the present invention provides 4,8-dimethyl-4,9-decadienenitrile.

Furthermore, the present invention provides a fragrance composition containing 4,8-dimethyl-4,9-decadienenitrile.

4,8-Dimethyl-4,9-decadienenitrile of the present invention has muguet, floral, and green odors that are useful as fragrances and is stable in an aqueous vehicle. Furthermore, 4,8-dimethyl-4,9-decadienenitrile of the present invention can be blended with another fragrance to enhance freshness and diffusibility.

The present invention provides 4,8-dimethyl-4,9-decadienenitrile.

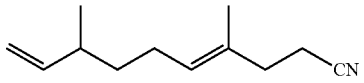

4,8-dimethyl-
4,9-decadienenitrile

Method for Producing 4,8-dimethyl-4,9-decadienenitrile 4,8-Dimethyl-4,9-decadienenitrile of the present invention can be synthesized using a common organic chemical reaction and the method for producing it is not limited. Preferably, the method for producing 4,8-dimethyl-4,9-decadienenitrile of the present invention is, for example, a method having a dehydration step in which 4,8-dimethyl-4,9-decadienal oxime (hereinafter, also referred to as an "oxime intermediate" in the present application) is dehydrated to yield 4,8-dimethyl-4,9-decadienenitrile.

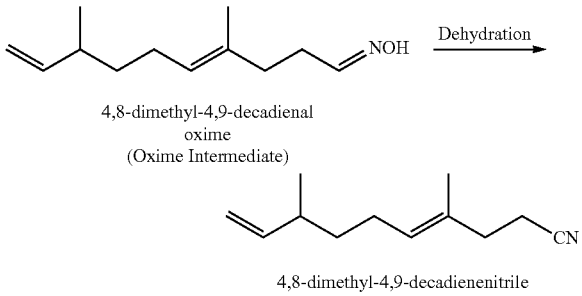

Preferably, the above-mentioned oxime intermediate is produced by, for example, a step of oximating 4,8-dimethyl-4,9-decadienal to yield 4,8-dimethyl-4,9-decadienal oxime (an oxime intermediate).

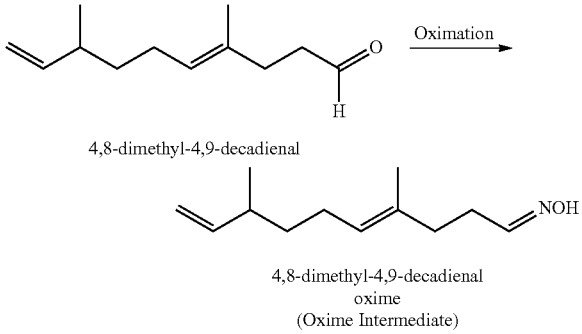

4,8-Dimethyl-4,9-decadienal can be produced according to know documents. Commercially available 4,8-dimethyl-4,9-decadienal is, for example, "Floral Super" (Trade Name) manufactured by IFF.

<Dehydration Step>

As described above, the production method of the present invention includes a step of dehydrating 4,8-dimethyl-4,9-decadienal oxime (an oxime intermediate) to yield 4,8-dimethyl-4,9-decadienenitrile.

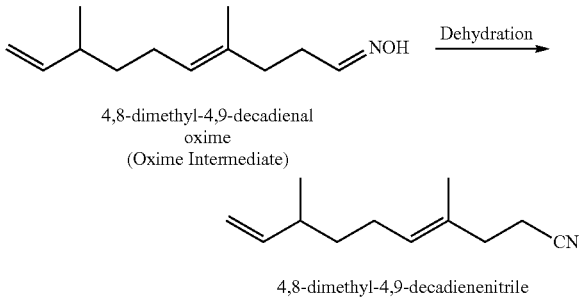

Preferably, this step is carried out by, for example, an acetic anhydride method using acetic anhydride or an alkali catalyst method using alkali. From the viewpoint of increasing the yield and the purity of the product to be obtained, the acetic anhydride method is more preferable.

[Acetic Anhydride Method]

The acetic anhydride method includes a step of dehydrating 4,8-dimethyl-4,9-decadienal oxime (an oxime intermediate) by heating in the presence of acetic anhydride to yield 4,8-dimethyl-4,9-decadienenitrile.

From the viewpoints of increasing the yield and the simplicity of the post-reaction treatment, the amount of the acetic anhydride to be used in the acetic anhydride method is preferably 1.0 to 10 times by mole, more preferably 1.0 to 5 times by mole, further preferably 1.0 to 1.5 times by mole with respect to the amount of the oxime intermediate.

From the viewpoint of completing the reaction efficiently, reaction temperature is preferably 120 to 200° C., more preferably 120 to 180° C., and further preferably 120 to 160° C., at which unreacted acetic anhydride and by-product acetic acid are refluxed sufficiently.

The reaction can be carried out in the absence of a solvent. However, from the viewpoint of gradual heating, the reaction can be carried out under reflux using a suitable amount of solvent having a boiling point around the preferred reaction temperature.

A reaction product, 4,8-dimethyl-4,9-decadienenitrile, as well as excess acetic anhydride and by-product acetic acid can be separated after reaction by a method in which they are distilled and neutralized with alkaline water to be acetate, which then is removed together with an aqueous layer.

[Alkali Catalyst Method]

An alkali catalyst method includes a step of dehydrating 4,8-dimethyl-4,9-decadienal oxime (an oxime intermediate) by heating in the presence of an alkali catalyst to yield 4,8-dimethyl-4,9-decadienenitrile.

In the alkali catalyst method, a hydroxide of alkali metal such as sodium hydroxide or potassium hydroxide is used preferably as the alkali catalyst.

The amount of the alkali catalyst to be used is preferably 0.1 to 20 mass % with respect to the oxime intermediate from the viewpoint of increasing the yield and more preferably 1 to 15 mass % from the viewpoint of the reaction controllability.

In the alkali catalyst method, it is preferable that the reaction is carried out while by-product water is removed out of the system. Examples of such a method include an azeotropic dehydration method that is carried out under solvent reflux and a continuous dehydration method in which the product also is removed out of the reaction system. Among them, from the viewpoint of inhibiting pyrolysis and thermal polymerization of 4,8-dimethyl-4,9-decadienenitrile to be obtained as a product, the continuous dehydration method is preferred in which the 4,8-dimethyl-4,9-decadienenitrile also is removed out of the reaction system.

The reaction temperature employed in the continuous dehydration method is preferably 80 to 250° C. from the viewpoints of completing the reaction efficiently and inhibiting pyrolysis and thermal polymerization of the oxime intermediate and 4,8-dimethyl-4,9-decadienenitrile and is more preferably 150 to 200° C. from the viewpoint of increasing the yield. In this case, from the viewpoints of distilling the 4,8-dimethyl-4,9-decadienenitrile efficiently in the preferable temperature range and inhibiting pyrolysis and thermal polymerization of the product, it is carried out preferably under reduced pressure and more preferably at 10 kPa or lower.

Furthermore, from the viewpoint of shortening the retention time of the oxime intermediate to inhibit side reactions, a preferred method is one in which the oxime intermediate is dripped continuously into the reaction system.

From the viewpoint of improving the quality of the 4,8-dimethyl-4,9-decadienenitrile obtained by either one of the methods so that it has a more preferable quality as a fragrance material, it is preferable that further distillation or silica gel column chromatography purification be carried out.

Hereinafter, an example of the production method is described in which the above-mentioned oxime intermediate is obtained according to the production method of the present invention.

<Oximation Step>

As described above, for example, the oximation reaction can be carried out using 4,8-dimethyl-4,9-decadienal and hydroxylamine to yield 4,8-dimethyl-4,9-decadienal oxime (an oxime intermediate).

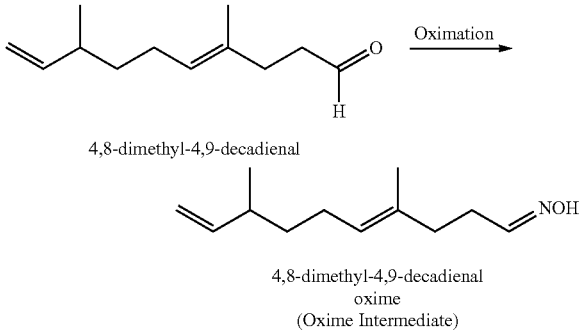

Examples of suitable methods to be used in this step include a method of dripping a hydroxylamine aqueous solution into 4,8-dimethyl-4,9-decadienal and a method of dripping a base into a mixture of 4,8-dimethyl-4,9-decadienal and an aqueous solution of an inorganic acid salt of hydroxylamine. Particularly, the later is preferable in which a base is dripped into a mixture of 4,8-dimethyl-4,9-decadienal and an aqueous solution of an inorganic acid salt of hydroxylamine. According to this method, there are advantages that dripping a base allows hydroxylamine to be produced in the reaction system, side reactions can be inhibited, and thus the reaction can be carried out safely.

From the viewpoints of inhibition of the side reactions and economic efficiency, it is preferable to use hydroxylamine sulfate as the inorganic acid salt of hydroxylamine used in this step.

From the viewpoints of simplicity in the post-reaction treatment and economic efficiency, the amount of the hydroxylamine or an inorganic acid salt thereof to be used is, in terms of hydroxylamine, preferably 1.0 to 3.0 times by mole, more preferably 1.0 to 2.0 times by mole, and further preferably 1.0 to 1.5 times by mole, with respect to 4,8-dimethyl-4,9-decadienal.

The base used in a suitable method of dripping the base is one of stronger bases than hydroxylamine and particularly it is preferably water soluble. From an economic perspective, preferable examples are alkali metal hydroxides such as sodium hydroxide and potassium hydroxide. From the viewpoints of handleability and operating efficiency, it is preferable to use an aqueous solution containing 20 to 40 mass % of alkali metal hydroxide.

The reaction can be carried out in the absence of a solvent. However, from the viewpoint of inhibiting the increase in viscosity of the reaction solution that is caused by gradual heating and the development of the reaction, it is preferable to use a solvent. Examples of preferable solvents include aliphatic alcohol and water that easily dissolve an aldehyde intermediate and hydroxylamine, which are the raw materials. The aliphatic alcohol is preferably aliphatic alcohol having 1 to 3 carbon atoms, more preferably linear aliphatic alcohol having 1 to 3 carbon atoms, and further preferably, for example, ethanol or isopropyl alcohol. The above-mentioned solvent is more preferably a mixture of aliphatic alcohol and water.

From the viewpoints of completing the reaction efficiently and inhibiting exothermic decomposition of hydroxylamine, it is preferable that the reaction temperature be maintained at 30 to 50° C.

The oxime intermediate, which is a reaction product, can be used for the subsequent reaction without further being processed after an aqueous layer is separated therefrom. Preferably, however, it is used after the solvent and a byproduct with a high boiling point are removed by, for example, distillation purification.

[Fragrance Composition]

The fragrance composition of the present invention contains 4,8-dimethyl-4,9-decadienenitrile. The amount of the 4,8-dimethyl-4,9-decadienenitrile contained in the fragrance composition is preferably 0.01 to 99 mass %, more preferably 0.1 to 15 mass %, and further preferably 0.3 to 3 mass %. When it contains 0.01 to 99 mass % of 4,8-dimethyl-4,9-decadienenitrile, freshness and diffusibility can be enhanced in the fragrance composition.

Since the fragrance composition of the present invention contains 4,8-dimethyl-4,9-decadienenitrile, it has muguet, floral, and green odors and is blended with another fragrance to have enhanced freshness and diffusibility. Furthermore, the fragrance composition of the present invention is allowed to contain, as another fragrance, another fragrance component that is generally used or a blended fragrance having a desired composition in addition to 4,8-dimethyl-4,9-decadienenitrile and thereby can be provided with an odor such as, for example, a citrus tone, a floral tone, a fruity tone, a herbal tone, a spicy tone, a green tone, a woody tone, or a balsam odor.

In the fragrance composition of the present invention, the another fragrance that can be used to be combined with 4,8-dimethyl-4,9-decadienenitrile is preferably at least one selected from hydrocarbons, alcohols, phenols, aldehydes, ketones, acetals, ethers, esters, carbonates, lactones, oximes, nitriles, Schiff bases, nitrogen-containing compounds, sulfur-containing compounds, natural essential oils, and natural extracts. Particularly, at least one selected from alcohols, aldehydes, ketones, acetals, ethers, esters, carbonates, lactones, and natural essential oils is more preferable from the viewpoint of enhancing the freshness and diffusibility by being blended with another fragrance.

Examples of hydrocarbons include limonene, α-pinene, β-pinene, terpinene, p-cymene, cedrene, longifolene, valencene, camphene, and myrcene.

Examples of alcohols include aliphatic alcohols, terpene-based alcohols, and aromatic alcohols.

Examples of aliphatic alcohols include prenol, trans-2-hexenol, cis-3-hexenol, 2,6-dimethylheptanol, 1-octen-3-ol, 3,6-nonadien-1-ol, Undecavertol (Trade Name of Givaudan, 4-methyl-3-decene-5-ol), 2,4-dimethyl-3-cyclohexene-1-methanol, isocyclogeraniol, 2-tert-butylcyclohexanol, 4-tert-butylcyclohexanol, Mayol (Trade Name of Firmenich, 4-(1-methylethyl)-cyclohexanemethanol), Amber Core (Trade Name of Kao Corporation), Timberol (Trade Name of Symrise, 1-(2,2,6-trimethylcyclohexyl)hexan-3-ol), Sandalmysore Core (Trade Name of Kao Corporation, 2-methyl-4-(2,2,3-trimethyl-3-cyclopenten-1-yl)-2-buten-1-ol), Bacdanol (Trade Name of IFF, 2-ethyl-4-(2,2,3-trimethyl-3-cyclopenten-1-yl)-2-buten-1-ol), and Florosa (Trade Name of Givaudan, 4-methyl-2-(2-methylpropyl)tetrahydro-2H-4-pyranol). Among them, cis-3-hexenol, Undecavertol, Mayol, or Florosa is preferable from the viewpoint of enhancing the freshness and diffusibility by being blended with another fragrance.

Examples of terpene-based alcohols include citronellol, hydroxycitronellol, linalool, dihydrolinalool, tetrahydrolinalool, ethyllinalool, geraniol, nerol, tetrahydrogeraniol, myrcenol, dihydromyrcenol, tetrahydromyrcenol, ocimenol, terpineol, menthol, borneol, fenchyl alcohol, farnesol, nerolidol, cedrol, and terpineol. Among them, citronellol, tetrahydrolinalool, ethyllinalool, geraniol, dihydromyrcenol, borneol, or terpineol is preferable from the viewpoint of enhancing the freshness and diffusibility by being blended with another fragrance.

Examples of aromatic alcohols include benzyl alcohol, styralyl alcohol, phenethyl alcohol, cumin alcohol, dimethyl phenyl ethyl carbinol, cinnamic alcohol, Phenyl Hexanol (Trade Name of Kao Corporation), Pamplefleur (Trade Name of IFF, 4-phenylpentanol), and Majantol (Trade Name of Symrise, 2,2-dimethyl-3-(3-methylphenypropanol).

Examples of phenols include anethole, guaiacol, eugenol, isoeugenol, and moss synth.

Examples of aldehydes include aliphatic aldehyde, terpene aldehyde, and aromatic aldehyde as in the case of the aforementioned alcohols. All the aldehydes in which only the functional group of the fragrance component alcohols has been converted are included in the examples of the fragrance components.

Examples of other aldehydes include Aldehyde C-6 (Trade Name of Kao Corporation, 1-hexanal), Aldehyde C-8 (Trade Name of Kao Corporation, 1-octanal), Aldehyde C-9 (Trade Name of Kao Corporation, 1-nonanal), Aldehyde C-10 (Trade Name of Kao Corporation, 1-decanal), Aldehyde C-11 Undecyl (Trade Name of Kao Corporation, undecanal), Aldehyde C-111 LEN (Trade Name of Kao Corporation, 10-undecenal), Aldehyde C-12 LAURYL (Trade Name of Kao Corporation, 1-dodecanal), Aldehyde C-12 MNA (Trade Name of Kao Corporation, 2-methyl-undecanal), cis-4-decenal, trans-4-decenal, Floral Super (Trade Name of IFF, 4,8-dimethyl-4,9-decadienal), Pollenal II (Trade Name of Kao Corporation, 2-cyclohexylpropanal), Myrac Aldehyde (Trade Name of IFF, 4(3)-(4-methyl-3-pentene-1-yl)-3-cyclohexene-1-carboxaldehyde), LYRAL (Trade Name of IFF, 4(3)-(4-hydroxy-4-methylpentyl)-3-cyclohexene-1-carboxaldehyde), Cetonal (Trade Name of Givaudan, trimethyl cyclohexene methylbutanal), Vernaldehyde (Trade Name of Givaudan, 1-methyl-4-(4-methylpentyl)-3-cyclohexenecarbaldehyde), Melozone (Trade Name of IFF, octahydro-4,7-methanoindenecarboxaldehyde), Scentenal (Trade Name of Firmenich, methoxydicyclopentadienecarboxaldehyde), Dupical (Trade Name of Givaudan, 4-tricyclodecylidenebutanal), Bergamal (Trade Name of IFF, 3,7-dimethyl-2-methylene-6-octenal), campholenic aldehyde, Bourgeonal (Trade Name of Givaudan, 3-(4-tert-butylphenyl)propanal), Cyclamen Aldehyde (Trade Name of Givaudan, 3-(4-isopropylphenyl)-2-methylpropionaldehyde), Floralozone (Trade Name of IFF, 3-(4-ethylphenyl)-2,2-dimethylpropionaldehyde), Suzaral (Trade Name of Takasago International Corporation, 3-(4-isobutylphenyl)-2-methylpropionaldehyde), Lilyall (Trade Name of Givaudan, 3-(4-t-butylphenyl)-2-methyl propionaldehyde), Amyl Cinnamic Aldehyde (Trade Name of Kao Corporation), Hexyl cinnamic aldehyde (Trade Name of Kao Corporation, 2-n-hexyl-3-phenyl-2-propenal), Canthoxal (Trade Name of IFF, 2-methyl-3-(4-methoxyphenyl) propanal), vanillin, ethyl vanillin, Heliotropine (Trade Name of Takasago International Corporation, 3,4-methylenedioxybenzaldehyde), Helional (Trade Name of IFF, α-methyl-1,3-benzodioxole-5-propanal), Triplal (Trade Name of IFF, 2,4-dimethyl-3-cyclohexene-1-carboxaldehyde), and 2,6-nonadienal. Among them, Dupical, Cyclamen Aldehyde, Floralozone, Lilyall, Hexyl cinnamic aldehyde, Canthoxal, Heliotropine, Helional, cis-4-decenal, or 2,6-nonadienal is preferable from the viewpoint of enhancing the freshness and diffusibility by being blended with another fragrance.

Examples of ketones include methyl heptenone, dimethyl octenone, 3-octanone, hexylcyclopentanone, dihydrojasmone, Veloutone (Trade Name of Firmenich, 2,2,5-trimethyl-5-pentylcyclopentanone), Nectaryl (Trade Name of Givaudan, 2-(2-(4-methyl-3-cyclohexen-1-yl)propyl)cyclopentanone), ionone, methylionone, γ-methylionone, damascone, α-damascone, δ-damascone, Isodamascone (Trade Name of Symrise, 1-(2,4,4-trimethyl-2-cyclohexyl)-trans-2-butanone), damascenone, Dynascone (Trade Name of Firmenich, 1-(5,5-dimethyl-1-cyclohexen-1-yl)-4-penten-1-one), irone, Cashmeran (Trade Name of IFF, 1,2,3,5,6,7-hexahydro-1,1,2,3,3-pentamethyl-4H-inden-4-one), Iso E Super (Trade Name of IFF, 1-(1,2,3,4,5,6,7,8-octahydro-2,3,8,8-tetramethyl-2-naphthalenyl)-ethan-1-one), CALONE (Trade Name of Firmenich, 7-methyl-3,4-dihydro-2H-benzodioxepin-3-one), carvone, menthone, acetyl cedrene, isolongifolanone, nootkatone, benzyl acetone, raspberry ketone, benzophenone, Tonalid (Trade Name of PFW, 6-acetyl-1,1,2,4,4,7-hexamethyl tetrahydronaphthalene), β-methyl naphthyl ketone, ethyl maltol, camphor, muscone, Muscenone (Trade Name of Firmenich, 3-methyl-5-cyclopentadecen-1-one), civetone, Globanone (Trade Name of Symrise, 8-cyclohexadecenone), and methyl nonyl ketone. Among them, α-damascone, Iso E Super, or camphor is preferable from the viewpoint of enhancing the freshness and diffusibility by being blended with another fragrance.

Examples of acetals include Anthoxan (Trade Name of Kao Corporation), Boisambrene Forte (Trade Name of Kao Corporation), Troenan (Trade Name of Kao Corporation), Methyl Pamplemousse (Trade Name of Givaudan, 1,1-dimethoxy-2,2,5-trimethyl-4-hexene), acetaldehyde ethyl linalyl acetal, citral dimethyl acetal, hydratropaldehyde dimethyl acetal, Verdoxan (Trade Name of Kao Corporation), and Floropal (Trade Name of Symrise, 2,4,6-trimethyl-4-phenyl-1,3-dioxane). Among them, acetaldehyde ethyl linalyl acetal is preferable from the viewpoint of enhancing the freshness and diffusibility by being blended with another fragrance.

Examples of ethers include Herbavert (Trade Name of Kao Corporation, 3,3,5-trimethylcyclohexyl ethyl ether), cedryl methyl ether, Ambroxan (Trade Name of Kao Corporation, [3aR-(3aα,5aβ,9aα,9bβ)]dodecahydro-3a,6,6,9a-tetramethyl naphto[2,1-b]furan), Ambrotech (Trade Name of Kao Corporation, dodecahydro-3a,6,6,9a-tetramethylnaphtho[2,1-b]furan), methyl isoeugenol, citronellyl ethyl ether, geranyl ethyl ether, 1,8-cineole, rose oxide, dihydro rose oxide, linalool oxide, estragole, anethole, hinokitiol, diphenyl oxide, β-naphthol methyl ether, β-naphthol ethyl ether, and Galaxolide (Trade Name of IFF, 1,3,4,6,7,8-hexahydro-4,6,6,7,8,8-hexamethylcyclopenta-γ-2-benzopyran). Among them, Herbavert or Ambrotech is preferable from the viewpoint of enhancing the freshness and diffusibility by being blended with another fragrance.

Examples of esters to be used as a fragrance material include aliphatic carboxylic acid ester, aromatic carboxylic acid ester, and other carboxylic acid esters.

Examples of aliphatic carboxylic acids that form aliphatic carboxylic acid ester include linear and branched carboxylic acids having 1 to 18 carbon atoms. Among them, carboxylic acids having 1 to 6 carbon atoms such as formic acid, acetic acid, and propionic acid, particularly, acetic acid are important. Examples of aromatic carboxylic acids that form aromatic carboxylic acid ester include benzoic acid, anisic acid, phenylacetic acid, cinnamic acid, salicylic acid, and anthranilic acid. Examples of alcohols that form aliphatic and aromatic esters include linear and branched aliphatic alcohols having 1 to 5 carbon atoms and the above-mentioned fragrance component alcohols.

Examples of other carboxylic acid esters include Ethyl Safranate (Trade Name of Givaudan, ethyl dihydrocyclo geranate), Poirenate (Trade Name of Kao Corporation, ethyl-2-cyclohexyl propionate), Fruitate (Trade Name of Kao Corporation, ethyl tricyclo[5.2.1.$0^{2,6}$]decan-2-carboxylate), methyl jasmonate, MDJ (Trade Name of Kao Corporation, methyl dihydrojasmonate, methyl (2-pentyl-3-oxocyclopentyl)acetate), and Cyclohexyl Salicylate (Trade Name of Kao Corporation). Among them, Poirenate or MDJ is preferable from the viewpoint of enhancing the freshness and diffusibility by being blended with another fragrance.

Examples of carbonates include Liffarome (Trade Name of IFF, cis-3-hexenyl methyl carbonate), Jasmacyclat (Trade Name of Kao Corporation), and Floramat (Trade Name of Kao Corporation). Among them, Jasmacyclat is preferable from the viewpoint of enhancing the freshness and diffusibility by being blended with another fragrance.

Examples of lactones include γ-nonalactone, γ-decalactone, δ-decalactone, Jasmolactone (Trade Name of Firmenich, tetrahydro-6-(3-pentenyl)-2H-pyran-2-one), γ-undecalactone, coumarin, octahydrocoumarin, Florex (Trade Name of Firmenich, 6-ethylideneoctahydro-5,8-methano-2H-1-benzopyran-2-one), cyclopentadecanolide, Habanolide (Trade Name of Firmenich, 12(11)-oxacyclohexadecen-2-one), Ambrettolide (Trade Name of IFF, 10-octacycloheptadecen-2-one), and ethylene brassylate. Among them, γ-decalactone, coumarin, or ethylene brassylate is preferable from the viewpoint of enhancing the freshness and diffusibility by being blended with another fragrance.

Examples of oximes include Buccoxime (Trade Name of Symrise, 1,5-dimethyl-bicyclo[3,2,1]octan-8-one oxime), Labienoxime (Trade Name of Givaudan, 2,4,4,7-tetramethyl-6,8-nonadiene-3-one oxime), and 5-methyl-3-heptanone oxime.

Examples of nitriles include dodecanenitrile, citronellyl nitrile, cuminyl nitrile, cinnamyl nitrile, and Peonile (Trade Name of Givaudan, 2-cyclohexylidene-2-phenylacetonitrile).

Examples of Schiff bases include Aurantiol (Trade Name of Givaudan, methyl N-(3,7-dimethyl-7-hydroxyoctylidene)-anthranilate), Ligantral (Trade Name of Givaudan, methyl (3,5-dimethyl-3-cyclohexene-1-yl)methyleneanthranilate), and methyl 2-[(2-methylundecylidene)amino]benzoate.

Examples of the nitrogen-containing compounds include amides, pyrroles, indoles, and thiazoles.

Examples of amides include Gardamide (Trade Name of Givaudan, N,2-dimethyl-N-phenylbutyramide) and Paradisamide (Trade Name of Givaudan, 2-ethyl-N-methyl-N-(3-methylphenyl)butanamide).

Examples of the sulfur-containing compounds include thiols, sulfides, thiophenes, and thiocarboxylic acids.

Examples of the natural essential oils and the natural extracts include orange, lemon, lime, bergamot, petitgrain, vanilla, mandarin, peppermint, spearmint, lavender, chamomile, rosemary, eucalyptus, sage, basil, rose, rockrose, geranium, jasmine, ylang ylang, anise, clove, ginger, nutmeg, cardamon, cedar, cypress, vetiver, patchouli, lemongrass, labdanum, galbanum, and olibanum. Among them, lemon, lavender, eucalyptus, or patchouli is preferable from the viewpoint of enhancing the freshness and diffusibility by being blended with another fragrance.

These other fragrances can be selected suitably depending on, for example, the type of the blended fragrance as well as the type and intensity of intended odor. However, in the fragrance composition, the amount of each of them contained therein is preferably 0.0001 to 99.99 mass %, more preferably 0.001 to 80 mass %. In the fragrance composition, the total amount of them contained therein is preferably 5 to 99.99 mass %, more preferably 50 to 99.9 mass %.

The fragrance composition of the present invention can contain an oil solution, which itself has no odor, to be used as a base that allows the 4,8-dimethyl-4,9-decadienenitrile of the present invention and other fragrance materials to be contained therein. Such an oil solution allows a fragrance component to be mixed uniformly, to be easily mixed into a product, and to be easily provided with a suitable intensity of fragrance. Examples of the oil solution include polyhydric alcohols such as ethylene glycol, propylene glycol, butylene glycol, and dipropylene glycol, esters such as isopropyl myristate, dibutyl adipate, and diethyl sebacate, hydrocarbons such as liquid paraffin and squalane, and surfactants such as polyoxyethylene alkyl ether and sorbitan fatty acid ester.

Among them, from the viewpoint of the solubility of all the fragrance components, the oil solution is preferably polyhydric alcohol or ester, more preferably dipropylene glycol or isopropyl myristate. The amount of such an oil solution to be contained in the fragrance composition is preferably 0.01 to 95 mass %, more preferably 1 to 90 mass %, and further preferably 5 to 80 mass %.

The fragrance composition of the present invention also provides an effect of further enhancing the freshness and diffusibility in addition to the odor of the 4,8-dimethyl-4,9-decadienenitrile. Such a fragrance composition can be used suitably to provide fragrances for cleanser compositions, softener compositions, cosmetics, etc.

[Use as Fragrance Component]

The fragrance composition containing the 4,8-dimethyl-4,9-decadienenitrile of the present invention can be used, as a fragrance component for various types of products, as a blended fragrance that is provided with muguet, floral, and green odors and that has a preferable fragrance note, with freshness and diffusibility being further enhanced. Therefore, it is an object of the present invention to provide a method of using 4,8-dimethyl-4,9-decadienenitrile as a fragrance component, preferably a method of using 4,8-dimethyl-4,9-decadienenitrile as a fragrance component of a fragrance composition, a softener composition, a hair cosmetic, or a cleanser composition. For the method of using said compound, it can be contained, alone or in combination with other components, in the bases of toiletry products such as soaps, cosmetics, hair cosmetics, detergents, softeners, spray products, air fresheners, perfumes, and bath agents.

Particularly, since the 4,8-dimethyl-4,9-decadienenitrile of the present invention is stable in an aqueous vehicle and is used, with a fragrance note with enhanced freshness and diffusibility being used preferably, it is used preferably for fiber treatment compositions, more preferably, particularly for cleanser compositions and softener compositions, and further preferably for cleanser compositions.

Accordingly, the present invention also provides a fiber treatment composition containing a fragrance composition of the present invention, particularly, a cleanser composition containing a fragrance composition of the present invention and a softener composition containing a fragrance composition of the present invention.

The softener composition of the present invention contains, for example, a tertiary amine having at least one hydrocarbon group having 14 to 26 total carbon atoms that may have been divided by an ester group, an amide group, or ether group, a salt thereof, or a quaternarized product thereof or a cation softener base and a fragrance composition of the present invention. The softener composition may further contain a nonionic surfactant, a germicide, a viscosity modifier, a pH adjuster, a sequestering agent, a storage stability improver, a solvent, etc.

The cation softener base to be used herein can be any conventionally known one. Examples thereof include a cationic surfactant. Examples of the cationic surfactant include an inorganic acid salt or an organic acid salt of a quaternary ammonium salt type surfactant and/or a tertiary amine type surfactant.

Examples of the nonionic surfactant include alkyl ethoxylate, oleyl ethoxylate, glyceryl ethoxylate, and dialkyl diether. Examples of the alkyl ethoxylate include polyoxyethylene (9) lauryl ether, polyoxyethylene (10) lauryl ether, polyoxyethylene (12) lauryl ether, polyoxyethylene (1.5) lauryl ether, polyoxyethylene (8) lauryl ether, polyoxyethylene (5.5) lauryl ether, and polyoxyethylene (20) lauryl ether.

Examples of the germicide include alcohols having 1 to 8 carbon atoms, benzoic acids, and phenols, and specifically, ethanol, propylene glycol, benzyl alcohol, salicylic acid, methyl p-hydroxybenzoate, and cresol.

Inorganic or organic salts (excluding a quaternary ammonium salt) can be used as the viscosity modifier. Specific examples thereof include sodium chloride, potassium chloride, calcium chloride, magnesium chloride, aluminum chloride, sodium sulfate, magnesium sulfate, potassium sulfate, sodium nitrate, magnesium nitrate, sodium p-toluenesulfonate, sodium glycolate, sodium acetate, potassium acetate, potassium glycolate, and sodium lactate. Preferably, the viscosity modifier is calcium chloride or magnesium chloride.

Examples of the storage stability improver include fatty acid (having 8 to 22 carbon atoms) ester of polyhydric alcohol having 2 to 6 carbon atoms.

The softener of the present invention contains water as a solvent, and generally the remainder of the composition is water. The water is preferably ion exchanged water or distilled water. The pH is more preferably 1.5 to 5 and further preferably 2 to 4.5.

Any inorganic or organic acid and alkali can be used for adjusting the pH of the softener of the present invention.

Examples of the sequestering agent include phosphonic acid or a salt thereof and aminopolyacetic acid or a salt thereof. Particularly, the sequestering agent is preferably ethane-1-hydroxy-1,1-diphosphonic acid, diethylenetriaminepenta-acetic acid, or ethylenediaminetetraacetic acid.

Furthermore, known components that usually are mixed in a softener as other optional components in addition to the above-mentioned components can be mixed in the softener of the present invention in a range that does not hinder the effects of the present invention. Examples of the optional components that can be mixed include: higher fatty acids such as stearic acid, oleic acid, and palmitic acid or esters thereof formed with lower alcohols; nonionic surfactants such as fatty acid glycerol ester, which is an ester of, for example, stearic acid and glycerol; higher alcohols such as stearyl alcohol, palmityl alcohol, and oleyl alcohol; and low-temperature stabilizers such as ethylene glycol and glycerol. In addition to these, for example, urea, pigments, a cellulose derivative, an ultraviolet absorber, and a fluorescent brightener can be mixed.

With respect to the above-described embodiment, the present invention further discloses 4,8-dimethyl-4,9-decadienenitrile and a method for producing 4,8-dimethyl-4,9-decadienenitrile.

<1> 4,8-dimethyl-4,9-decadienenitrile.

<2> A fragrance composition containing 4,8-dimethyl-4,9-decadienenitrile.

<3> The fragrance composition according to the item <2>, wherein the amount of the 4,8-dimethyl-4,9-decadienenitrile to be contained in the fragrance composition is preferably 0.01 to 99 mass %, more preferably 0.1 to 15 mass %, and further preferably 0.3 to 3 mass %.

<4> The fragrance composition according to the item <2> or <3>, further containing a fragrance other than the 4,8-dimethyl-4,9-decadienenitrile.

<5> The fragrance composition according to the item <4>, wherein the fragrance other than the 4,8-dimethyl-4,9-decadienenitrile contains at least one selected from hydrocarbons, alcohols, phenols, aldehydes, ketones, acetals, ethers, esters, carbonates, lactones, oximes, nitriles, Schiff bases, nitrogen-containing compounds, sulfur-containing compounds, natural essential oils, and natural extracts.

<6> A fiber treatment composition containing a fragrance composition according to any one of the items <2> to <5>.

<7> A cleanser composition containing a fragrance composition according to any one of the items <2> to <5>.

<8> A softener composition containing a fragrance composition according to any one of the items <2> to <5>.

<9> A method of using 4,8-dimethyl-4,9-decadienenitrile as a fragrance component of a fragrance composition, a softener composition, a hair cosmetic, or a cleanser composition.

<10> A method for producing 4,8-dimethyl-4,9-decadienenitrile, including a dehydration step of dehydrating 4,8-dimethyl-4,9-decadienal oxime to yield 4,8-dimethyl-4,9-decadienenitrile.

<11> The method for producing 4,8-dimethyl-4,9-decadienenitrile according to the item <10>, wherein the dehydration step is carried out by an acetic anhydride method using acetic anhydride or an alkali catalyst method using alkali.

<12> The method for producing 4,8-dimethyl-4,9-decadienenitrile according to the item <11>, wherein the dehydration step is carried out by the acetic anhydride method in which 4,8-dimethyl-4,9-decadienal oxime (an oxime intermediate) is dehydrated by heating in the presence of acetic anhydride to yield 4,8-dimethyl-4,9-decadienenitrile.

<13> The method for producing 4,8-dimethyl-4,9-decadienenitrile according to the item <12>, wherein the amount of the acetic anhydride to be used is, with respect to the oxime intermediate, preferably 1.0 to 10 times by mole, more preferably 1.0 to 5 times by mole, and further preferably 1.0 to 1.5 times by mole.

<14> The method for producing 4,8-dimethyl-4,9-decadienenitrile according to the item <11>, wherein the dehydration step is carried out by the alkali catalyst method in which 4,8-dimethyl-4,9-decadienal oxime (an oxime intermediate) is dehydrated by heating in the presence of an alkali catalyst (preferably, alkali metal hydroxide such as sodium hydroxide or potassium hydroxide) to yield 4,8-dimethyl-4,9-decadienenitrile.

<15> The method for producing 4,8-dimethyl-4,9-decadienenitrile according to the item <14>, wherein the amount of the alkali catalyst to be used is, with respect to the oxime intermediate, preferably 0.1 to 20 mass %, more preferably 1 to 15 mass %.

<16> The method for producing 4,8-dimethyl-4,9-decadienenitrile according to the item <14>, wherein the alkali catalyst method is performed, with a reaction being carried out while by-product water is removed out of the system, and is performed preferably by an azeotropic dehydration method under solvent reflux or by a continuous dehydration method in which a product also is removed out of the reaction system.

<17> The method for producing 4,8-dimethyl-4,9-decadienenitrile according to any one of the items <10> to <16>, wherein the 4,8-dimethyl-4,9-decadienal oxime is yielded by oximating 4,8-dimethyl-4,9-decadienal.

<18> The method for producing 4,8-dimethyl-4,9-decadienenitrile according to the item <17>, wherein the oximating is carried out by a method in which a hydroxylamine aqueous solution is dripped into 4,8-dimethyl-4,9-decadienal, or a method in which a base (preferably, alkali metal hydroxide such as sodium hydroxide or potassium hydroxide) is dripped into a mixture of 4,8-dimethyl-4,9-decadienal and an aqueous solution of inorganic acid salt of hydroxylamine (preferably, hydroxylamine sulfate).

<19> The method for producing 4,8-dimethyl-4,9-decadienenitrile according to the item <18>, wherein the amount of the hydroxylamine or inorganic acid salt thereof to be used is, in terms of hydroxylamine, preferably 1.0 to 3.0 times by mole, more preferably 1.0 to 2.0 times by mole, and further preferably 1.0 to 1.5 times by mole, with respect to 4,8-dimethyl-4,9-decadienal.

EXAMPLES

The following examples further describe and demonstrate embodiments of the present invention. The examples are given solely for the purpose of illustration and are not to be construed as limitations of the present invention.

Hereinafter, details of the measurement methods carried out in the following examples and comparative examples are described together below.

Hereinafter, details of the measurement methods carried out in the following production example are described together below.

[Conversion Ratio and Reaction Yield]

The conversion ratio and the reaction yield described in the following production example were determined by an internal standard method of gas chromatography (GC) quantitative analysis.

<Apparatus and Analytical Conditions for Gas Chromatography>

GC Apparatus: HP6850, manufactured by HEWLETT PACKARD

Column: DB-1 (Inner Diameter: 0.25 mm, Length: 30 m, and Film Thickness: 0.25 μm), manufactured by J&W Carrier Gas: He, 1.5 mL/min Injection Condition: 280° C., Split Ratio: 1/100

Detection Condition: FID System, 280° C.

Column Temperature Condition: Raised from 100° C. to 300° C. at 6° C./min then maintained at 300° C. for 10 minutes Internal Standard Compound: n-dodecane

[Compound Identification]

Each compound obtained in the following production example was identified by spectrum analyses using a nuclear magnetic resonance spectrum (Mercury 400, manufactured by Varian) ($^{1}$H-NMR, $^{13}$C-NMR), a Fourier transform infrared spectrophotometer (FT-710, manufactured by HORIBA, Ltd.), and a gas chromatography mass spectrometer (GC-MS) (GC-2010, manufactured by Shimadzu Corporation). The measurement conditions, etc. are described in each measurement result.

[Odor Evaluation]

Two experts who had an experience of at least five years but less than ten years as well as three experts who had an experience of at least 25 years of blending odors and evaluating fragrances determined the fragrance note and the intensity by a smelling strip method. About 5 mm of the end of each smelling strip (fragrance test paper with a width of 6 mm and a length of 150 mm) was immersed in a sample and thereby evaluation was performed.

With respect to the odor, fragrances that are sensed mainly (main odors) were listed from the strongest to the weakest and further fragrances that are sensed secondarily (secondary odors) were noted.

The odor intensity was indicated by the relative evaluation, with 0 denoting odorless and 5 denoting very strong.

Production Example 1

Production of 4,8-dimethyl-4,9-decadienal oxime

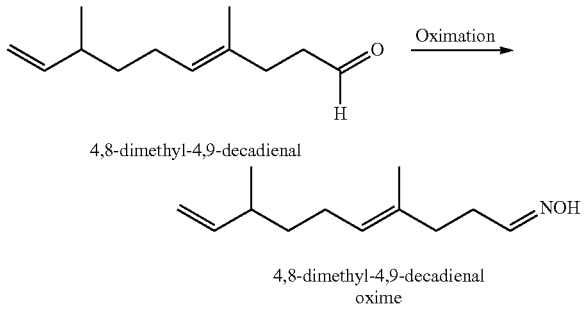

In a 2 L flask, 287 g of 4,8-dimethyl-4,9-decadienal (Floral Super, Trade Name of IFF, 1.59 moles), 300 g of isopropyl alcohol, 144 g of hydroxylamine sulfate (0.88 mole, 0.55 times by mole with respect to the amount of aldehyde, 1.10 times by mole in terms of hydroxylamine), and 272 g of ion exchanged water were added sequentially. This was heated to 45° C. while being stirred in a nitrogen atmosphere. While the reaction temperature was kept at 40 to 50° C., 212 g (1.75 moles) of 33 mass % sodium hydroxide aqueous solution was dripped over two hours. Further, heating and stirring were continued for one hour. After the reaction solution was cooled to room temperature, an aqueous layer was extracted by settled separation. An organic layer was washed with a 10 mass % sodium sulfate aqueous solution and then isopropyl alcohol was removed from the organic layer by distillation, which yielded 338 g of a pale yellow liquid crude product. As a result of gas chromatography quantitative analysis of the crude product, 4,8-dimethyl-4,9-decadienal had a conversion ratio of 100% and 4,8-dimethyl-4,9-decadienal oxime had a purity of 84% and a crude yield of 91%.

Then 30 g of this crude product was purified by vacuum distillation and thereby a colorless liquid that was distilled at 96 to 100° C./27 Pa was obtained. The 4,8-dimethyl-4,9-decadienal oxime had a purity of 95%.

The measurement results of each spectrum analysis and odor evaluation are indicated below.

(1) MS (the EI method); m/z; 195 (Mt), 178, 162, 121, 108, 95, 81, 67, 55, 41

(2) FT-IR (neat); cm$^{-1}$; 3261 (br), 2958, 2912, 2364, 1639, 1450, 995, 908, 681

(3) Odor: (Main Odor) Green, (Secondary Odor) Citrus (4) Odor Intensity: 2

Example 1

Production of 4,8-dimethyl-4,9-decadienenitrile

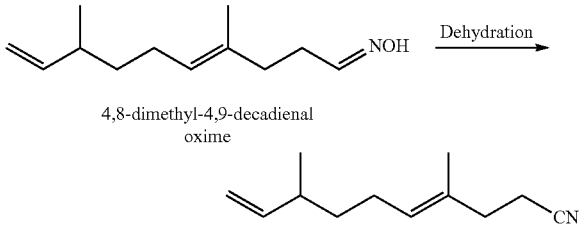

In a 1 L flask, 300 g of 4,8-dimethyl-4,9-decadienal oxime (the crude product of Production Example 1, with a pure content of 252 g, 1.29 moles) and 70 g of toluene were added, which was stirred in a nitrogen atmosphere. Then 144 g of acetic anhydride (1.41 moles, 1.09 times by mole with respect to the amount of 4,8-dimethyl-4,9-decadienal oxime) was dripped over 30 minutes. Subsequently, by-product acetic acid was refluxed for two hours (125° C.). After the reaction solution was cooled to room temperature, 100 g of water was added thereto, which further was neutralized with a dilute sodium hydroxide aqueous solution. After 300 g of ethyl acetate was added thereto, an aqueous layer was extracted by settled separation. An organic layer was further washed twice with a 10 mass % sodium sulfate aqueous solution and then ethyl acetate was removed by distillation from the organic layer, which yielded 287 g of a dark brown liquid crude product. As a result of gas chromatography quantitative analysis of the crude product, 4,8-dimethyl-4,9-decadienal oxime had a conversion ratio of 100% and 4,8-dimethyl-4,9-decadienenitrile had a purity of 64% and a crude yield of 80%.

Then 200 g of this crude product was purified by vacuum distillation and thereby a pale yellow liquid that was distilled at 104 to 107° C./133 Pa was obtained. The 4,8-dimethyl-4,9-decadienenitrile had a purity of 97%.

The measurement results of each spectrum analysis and odor evaluation are indicated below.

(1) MS (the EI method); m/z: 177 (Mt), 162, 121, 95, 81, 67, 55, 41

(2) $^{1}$H-NMR ($CDCl_3$, 400 MHz); δ (ppm): 0.99 (3H, d, J=7.2 Hz), 1.34 (2H, dt, J=7.6, 7.5 Hz), 1.62 (3H, s), 2.00 (2H, dt, 7.5, 6.6 Hz), 2.13 (1H, dtq, J=10.0, 7.6, 7.2 Hz), 2.30 (2H, t, J=7.2 Hz), 2.43 (2H, t, J=7.2 Hz), 4.92 (1H, d, J=7.6 Hz), 4.95 (1H, d, J=17.2 Hz), 5.25 (1H, t, J=6.6 Hz), 5.67 (1H, ddd, J=17.2, 10.0, 7.6 Hz)

(3) $^{13}$C-NMR ($CDCl_3$, 100 MHz); δ (ppm): 16.4, 16.8, 20.7, 26.1, 36.7, 37.1, 37.8, 113.0, 119.7, 127.9, 131.1, 144.6

(4) FT-IR (neat); $cm^{-1}$: 2962, 2912, 2862, 2247, 1452, 1425, 995, 910

(5) Odor: (Main Odor) Muguet, (Secondary Odor) Floral, Green (6) Odor Intensity: 4

Example 2 and Comparative Examples 1 and 2

Fragrance Composition for Body Cleansing Agent

Using the 4,8-dimethyl-4,9-decadienenitrile obtained in Example 1, a fragrance was prepared in such a manner as to have a mixed composition indicated in Table 1. Thus a fragrance composition was obtained (Example 2). Furthermore, a fragrance composition was obtained in the same manner as in Example 2 except that the 4,8-dimethyl-4,9-decadienenitrile was not used (Comparative Example 1). A fragrance composition was obtained in the same manner as in Example 2 except that 4,8-dimethyl-4,9-decadienal (Floral Super, Trade Name of IFF) was used instead of the 4,8-dimethyl-4,9-decadienenitrile (Comparative Example 2).

TABLE 1

| | (Unit: Part by Weight (Part by Mass)) | | |
|---|---|---|---|
| | Ex. 2 | C. Ex. 1 | C. Ex. 2 |
| Benzyl acetate | 1 | 1 | 1 |
| Cinnamyl acetate | 3 | 3 | 3 |
| cis-3-Hexenol | 0.5 | 0.5 | 0.5 |
| cis-3-hexenyl acetate | 1 | 1 | 1 |
| cis-4-Decenal 1%/DPG | 0.3 | 0.3 | 0.3 |
| Dihydro rose oxide | 1 | 1 | 1 |
| γ-Decalactone (Trade Name of Kao Corporation) | 0.3 | 0.3 | 0.3 |
| Dupical (Trade Name of Givaudan)[1)] | 1 | 1 | 1 |
| Ethyllinalool | 50 | 50 | 50 |
| Floralozone (Trade Name of IFF)[2)] | 2 | 2 | 2 |
| Florosa (Trade Name of Givaudan)[3)] | 200 | 200 | 200 |
| Heliotropine (Trade Name of Takasago International Corporation)[4)] | 3 | 3 | 3 |
| Indole | 1.5 | 1.5 | 1.5 |
| Linalool oxide | 1 | 1 | 1 |
| Mayol (Trade Name of Firmenich)[5)] | 10 | 10 | 10 |
| MDJ (Trade Name of Kao Corporation)[6)] | 100 | 100 | 100 |
| Methyl benzoate | 1 | 1 | 1 |
| Phenoxyethyl isobutyrate | 10 | 10 | 10 |
| Prenyl acetate | 1 | 1 | 1 |
| 4,8-Dimethyl-4,9-decadienenitrile (Compound of the present invention) | 5 | 0 | 0 |
| Floral Super (Trade Name of IFF)[7)] | 0 | 0 | 5 |
| Dipropylene glycol | 607.4 | 612.4 | 607.4 |
| Total | 1000 | 1000 | 1000 |

[1)]Trade Name of Givaudan: 4-tricyclodecylidenebutanal
[2)]Trade Name of IFF: 3-(4-ethylphenyl)-2,2-dimethylpropionaldehyde
[3)]Trade Name of Givaudan: 4-methyl-2-(2-methylpropyl)tetrahydro-2H-4-pyranol
[4)]Trade Name of Takasago International Corporation: 3,4-methylenedioxybenzaldehyde
[5)]Trade Name of Firmenich: 4-(1-methylethyl)-cyclohexanemethanol
[6)]Trade Name of Kao Corporation: methyl dihydrojasmonate, methyl (2-pentyl-3-oxocyclopentyl)acetate
[7)]Trade Name of IFF: 4,8-dimethyl-4,9-decadienal The evaluation was performed in the same manner as in the aforementioned odor evaluation. Compared to the fragrance composition of Comparative Example 1, the fragrance composition of Example 2 was provided with a fresh muguet odor and had enhanced diffusibility and arising odor of the whole composition. Furthermore, when the fragrance composition of Comparative Example 2 and the fragrance composition of Example 2 are compared with each other, the fragrance composition of Comparative Example 2 was slightly fishy smelling and had a darker fragrance, while the fragrance composition of Example 2 had increased arising odor and freshness. The aforementioned tendencies were found strongly, particularly in a citrus-aquatic part.

Example 3, Comparative Examples 3 and 4

Fragrance Composition for Softener and Softener Composition

Using the 4,8-dimethyl-4,9-decadienenitrile obtained in Example 1, a fragrance was prepared in such a manner as to have a mixed composition indicated in Table 2. Thus a fragrance composition was obtained (Example 3). Furthermore, a fragrance composition was obtained in the same manner as in Example 3 except that the 4,8-dimethyl-4,9-decadienenitrile was not used (Comparative Example 3). A fragrance composition was obtained in the same manner as in Example 3 except that 4,8-dimethyl-4,9-decadienal (Floral Super, Trade Name of IFF) was used instead of the 4,8-dimethyl-4,9-decadienenitrile (Comparative Example 4). Furthermore, a non-perfumed liquid softener A was prepared in such a manner as to have a mixed composition indicated in Table 3. Then 0.5 mass % of said fragrance composition for a softener was added to the non-perfumed liquid softener A and thus a softener composition was prepared.

TABLE 2

| | (Unit: Part by Weight (Part by Mass)) | | |
|---|---|---|---|
| | Ex. 3 | C. Ex. 3 | C. Ex. 4 |
| Allyl Amyl Glycolate (Trade Name of IFF) | 1 | 1 | 1 |
| Ambrotech (Trade Name of Kao Corporation)[1] | 1 | 1 | 1 |
| Borneol | 2 | 2 | 2 |
| Camphor | 20 | 20 | 20 |
| Citronellol | 30 | 30 | 30 |
| Coumarin | 10 | 10 | 10 |
| Cyclohexyl Salicylate (Trade Name of Kao Corporation) | 50 | 50 | 50 |
| Dihydromyrcenol | 30 | 30 | 30 |
| Ethylene brassylate | 30 | 30 | 30 |
| Eucalyptus (Natural essential oil) | 30 | 30 | 30 |
| Herbavert (Trade Name of Kao Corporation)[2] | 15 | 15 | 15 |
| Hexyl Cinnamic Aldehyde (Trade Name of Kao Corporation)[3] | 100 | 100 | 100 |
| Iso E Super (Trade Name of IFF)[4] | 50 | 50 | 50 |
| Lavandin Grosso (Natural essential oil) | 100 | 100 | 100 |
| Lavender M.B 40/42 (Natural essential oil) | 30 | 30 | 30 |
| Lemon California (Natural essential oil) | 10 | 10 | 10 |
| Lilyall (Trade Name of Givaudan)[5] | 30 | 30 | 30 |
| MDJ (Trade Name of Kao Corporation)[6] | 100 | 100 | 100 |
| Methyl nonyl ketone | 2 | 2 | 2 |
| moss synth | 3 | 3 | 3 |
| Patchouli Iron Free (Natural essential oil) | 1 | 1 | 1 |
| Poirenate (Trade Name of Kao Corporation)[7] | 10 | 10 | 10 |
| 2-tert-Butylcyclohexanol acetate | 10 | 10 | 10 |
| 4-tert-Butylcyclohexanol acetate | 50 | 50 | 50 |
| Terpinyl acetate | 50 | 50 | 50 |
| Tetrahydrolinalool | 150 | 150 | 150 |
| 4,8-Dimethyl-4,9-decadienenitrile (Compound of the present invention) | 10 | 0 | 0 |
| Floral Super (Trade Name of IFF)[8] | 0 | 0 | 10 |
| Dipropylene glycol | 75 | 85 | 75 |
| Total | 1000 | 1000 | 1000 |

[1]Trade Name of Kao Corporation: dodecahydro-3a,6,6,9a-tetramethylnaphtho[2,1-b]furan
[2]Trade Name of Kao Corporation: 3,3,5-trimethylcyclohexyl ethyl ether
[3]Trade Name of Kao Corporation: 2-n-hexyl-3-phenyl-2-propenal
[4]Trade Name of IFF: 1-(1,2,3,4,5,6,7,8-octahydro-2,3,8,8-tetramethyl-2-naphthalenyl)-ethan-1-one
[5]Trade Name of Givaudan: 3-(4-t-butylphenyl)-2-methyl propionaldehyde
[6]Trade Name of Kao Corporation: methyl dihydrojasmonate, methyl (2-pentyl-3-oxocyclopentyl)acetate
[7]Trade Name of Kao Corporation: ethyl-2-cyclohexyl propionate
[8]Trade Name of IFF: 4,8-dimethyl-4,9-decadienal

TABLE 3

| Non-Perfumed Liquid Softener A | Mixing Amount (mass %) |
|---|---|
| Cation softener base[1] | 5.6 |
| 40% Formaldehyde | 0.1 |
| Ion exchanged water | Remainder to make it 100 mass % |
| pH | 3.5 |

[1]Trade Name of Kao Corporation: Tetranyl L1/90S

The evaluation was performed in the same manner as in the aforementioned odor evaluation. Compared to the case where Comparative Example 3 was used, the softener containing the fragrance composition of Example 3 used therein had a significantly enhanced sweet lavender odor and had freshness provided for the fragrance as a whole. Furthermore, when the softener containing the fragrance composition of Comparative Example 4 used therein was compared to the softener containing the fragrance composition of Example 3 used therein, the softener containing the fragrance composition of Comparative Example 4 used therein had weaker lavender characteristics and an excessively strong muguet element, while the softener containing the fragrance composition of Example 3 used therein provided an enhanced fresh feeling, with the lavender characteristics being not impaired.

Example 4, Comparative Example 5 and 6

Fragrance Composition for Shampoo

Using the 4,8-dimethyl-4,9-decadienenitrile obtained in Example 1, a fragrance was prepared in such a manner as to have a mixed composition indicated in Table 4. Thus a fragrance composition was obtained (Example 4). Furthermore, a fragrance composition was obtained in the same manner as in Example 4 except that the 4,8-dimethyl-4,9-decadienenitrile was not used (Comparative Example 5). A fragrance composition was obtained in the same manner as in Example 4 except that 4,8-dimethyl-4,9-decadienal (Floral Super, Trade Name of IFF) was used instead of the 4,8-dimethyl-4,9-decadienenitrile (Comparative Example 6).

TABLE 4

| | (Unit: Part by Weight (Part by Mass)) | | |
|---|---|---|---|
| | Ex. 4 | C. Ex. 5 | C. Ex. 6 |
| Acetaldehyde ethyl linalyl acetal | 5 | 5 | 5 |
| Canthoxal (Trade Name of IFF)[1] | 10 | 10 | 10 |
| Citronellol | 75 | 75 | 75 |
| Cyclamen Aldehyde (Trade Name of Givaudan)[2] | 50 | 50 | 50 |
| α-Damascone | 1.5 | 1.5 | 1.5 |
| Floralozone (Trade Name of IFF) | 15 | 15 | 15 |
| Geraniol | 25 | 25 | 25 |
| Helional (Trade Name of IFF) | 15 | 15 | 15 |
| Jasmacyclat (Trade Name of Kao Corporation) | 50 | 50 | 50 |
| MDJ (Trade Name of Kao Corporation)[3] | 250 | 250 | 250 |
| 2,6-Nonadienal 10%/DPG | 0.5 | 0.5 | 0.5 |
| Terpineol special | 75 | 75 | 75 |
| Tetrahydrolinalool | 100 | 100 | 100 |
| Undecavertol (Trade Name of Givaudan)[4] | 10 | 10 | 10 |
| 4,8-Dimethyl-4,9-decadienenitrile (Compound of the present invention) | 2.5 | 0 | 0 |
| Floral Super (Trade Name of IFF)[5] | 0 | 0 | 2.5 |
| Dipropylene glycol | 315.5 | 318 | 315.5 |
| Total | 1000 | 1000 | 1000 |

[1]Trade Name of IFF: 2-methyl-3-(4-methoxyphenyl)propanal
[2]Trade Name of Givaudan: 3-(4-isopropylphenyl)-2-methylpropionaldehyde
[3]Trade Name of Kao Corporation: methyl dihydrojasmonate, methyl (2-pentyl-3-oxocyclopentyl)acetate
[4]Trade Name of Givaudan: 4-methyl-3-decene-5-ol
[5]Trade Name of IFF: 4,8-dimethyl-4,9-decadienal The evaluation was performed in the same manner as in the aforementioned odor evaluation. Compared to Comparative Example 5, the fragrance composition of Example 4 had freshness and diffusibility provided for the fragrance as a whole. Furthermore, when the fragrance composition of Comparative Example 6 is compared to the fragrance composition of Example 4, the fragrance composition of Comparative Example 6 had a settled darker fragrance, while the fragrance composition of Example 4 had enhanced crisp freshness. The aforementioned tendencies were found strongly, particularly in a green-aquatic part.

Since the 4,8-dimethyl-4,9-decadienenitrile of the present invention has strong muguet, floral, and green odors that are useful as a fragrance, it can be used as a fragrance material. Furthermore, it is stable in an aqueous vehicle. Moreover, when being blended with another fragrance, the 4,8-dimethyl-4,9-decadienenitrile of the present invention can have enhanced freshness and diffusibility. Thus, fragrance compositions containing the 4,8-dimethyl-4,9-decadienenitrile of the present invention can be used as fragrance components for cosmetics and cleanser compositions.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. 4,8-Dimethyl-4,9-decadienenitrile.

2. A fragrance composition, comprising 4,8-dimethyl-4,9-decadienenitrile.

3. The fragrance composition according to claim 2, further comprising a fragrance other than 4,8-dimethyl-4,9-decadienenitrile.

4. The fragrance composition according to claim 3, wherein said fragrance other than 4,8-dimethyl-4,9-decadienenitrile is at least one member selected from the group consisting of a hydrocarbon, an alcohol, a phenol, an aldehyde, a ketone, an acetal, an ether, an ester, a carbonate, a lactone, an oxime, a nitrile, a Schiff base, a nitrogen-containing compound, a sulfur-containing compound, a natural essential oil, and a natural extract.

5. A fiber treatment composition, comprising a fragrance composition according to claim 2.

6. A cleanser composition, comprising a fragrance composition according to claim 2.

7. A softener composition, comprising a fragrance composition according to claim 2.

8. The fragrance composition according to claim 3, wherein said fragrance other than 4,8-dimethyl-4,9-decadienenitrile is at least one member selected from the group consisting of prenol, trans-2-hexenol, cis-3-hexenol, 2,6-dimethylheptanol, 1-octen-3-ol, 3,6-nonadien-1-ol, 4-methyl-3-decene-5-ol, 2,4-dimethyl-3-cyclohexene-1-methanol, isocyclogeraniol, 2-tert-butylcyclohexanol, 4-tert-butylcyclohexanol, 4-(1-methylethyl)-cyclohexanemethanol, 1-(2,2,6-trimethylcyclohexyl)hexan-3-ol, 2-methyl-4-(2,2,3-trimethyl-3-cyclopenten-1-yl)-2-buten-1-ol, 2-ethyl-4-(2,2,3-trimethyl-3-cyclopenten-1-yl)-2-buten-1-ol, and 4-methyl-2-(2-methylpropyl)tetrahydro-2H-4-pyranol.

9. The fragrance composition according to claim 3, wherein said fragrance other than 4,8-dimethyl-4,9-decadienenitrile is at least one member selected from the group consisting of citronellol, hydroxycitronellol, linalool, dihydrolinalool, tetrahydrolinalool, ethyllinalool, geraniol, nerol, tetrahydrogeraniol, myrcenol, dihydromyrcenol, tetrahydromyrcenol, ocimenol, terpineol, menthol, borneol, fenchyl alcohol, farnesol, nerolidol, cedrol, and terpineol.

10. The fragrance composition according to claim 3, wherein said fragrance other than 4,8-dimethyl-4,9-decadienenitrile is at least one member selected from the group consisting of anethole, guaiacol, eugenol, and isoeugenol.

11. The fragrance composition according to claim 3, wherein said fragrance other than 4,8-dimethyl-4,9-decadienenitrile is at least one member selected from the group consisting of 1-hexanal, 1-octanal, 1-nonanal, 1-decanal, undecanal, 10-undecenal, 1-dodecanal, 2-methyl-undecanal, cis-4-decenal, trans-4-decenal, 4,8-dimethyl-4,9-decadienal, 2-cyclohexylpropanal, 4(3)-(4-methyl-3-pentene-1-yl)-3-cyclohexene-1-carboxaldehyde, 4(3)-(4-hydroxy-4-methylpentyl)-3-cyclohexene-1-carboxaldehyde, trimethyl cyclohexene methylbutanal, 1-methyl-4-(4-methylpentyl)-3-cyclohexenecarbaldehyde, octahydro-4,7-methanoindenecarboxaldehyde, methoxydicyclopentadienecarboxaldehyde, 4-tricyclodecylidenebutanal, 3,7-dimethyl-2-methylene-6-octenal, campholenic aldehyde, 3-(4-tert-butylphenyl)propanal, 3-(4-isopropylphenyl)-2-methylpropionaldehyde, 3-(4-ethylphenyl)-2,2-dimethylpropionaldehyde, 3-(4-isobutylphenyl)-2-methylpropionaldehyde, 3-(4-t-butylphenyl)-2-methyl propionaldehyde, amyl cinnamic aldehyde, 2-n-hexyl-3-phenyl-2-propenal, 2-methyl-3-(4-methoxyphenyl)propanal, vanillin, ethyl vanillin, 3,4-methylenedioxybenzaldehyde, α-methyl-1,3-benzodioxole-5-propanal, 2,4-dimethyl-3-cyclohexene-1-carboxaldehyde, and 2,6-nonadienal.

12. The fragrance composition according to claim 3, wherein said fragrance other than 4,8-dimethyl-4,9-decadienenitrile is at least one member selected from the group consisting of methyl heptenone, dimethyl octenone, 3-octanone, hexylcyclopentanone, dihydrojasmone, 2,2,5-trimethyl-5-pentylcyclopentanone, 2-(2-(4-methyl-3-cyclohexen-1-yl)propyl)cyclopentanone, ionone, methylionone, γ-methylionone, damascone, α-damascone, δ-damascone, 1-(2,4,4-trimethyl-2-cyclohexyl)-trans-2-butanone, damascenone, 1-(5,5-dimethyl-1-cyclohexen-1-yl)-4-penten-1-one, irone, 1,2,3,5,6,7-hexahydro-1,1,2,3,3-pentamethyl-4H-inden-4-one, 1-(1,2,3,4,5,6,7,8-octahydro-2,3,8,8-tetramethyl-2-naphthalenyl)-ethan-1-one, 7-methyl-3,4-dihydro-2H-benzodioxepin-3-one, carvone, menthone, acetyl cedrene, isolongifolanone, nootkatone, benzyl acetone, raspberry ketone, benzophenone, 6-acetyl-1,1,2,4,4,7-hexamethyl tetrahydronaphthalene, n-methyl naphthyl ketone, ethyl maltol, camphor, muscone, 3-methyl-5-cyclopentadecen-1-one, civetone, 8-cyclohexadecenone, and methyl nonyl ketone.

13. The fragrance composition according to claim 3, wherein said fragrance other than 4,8-dimethyl-4,9-decadienenitrile is at least one member selected from the group consisting of 1,1-dimethoxy-2,2,5-trimethyl-4-hexene, acetaldehyde ethyl linalyl acetal, citral dimethyl acetal, hydratropaldehyde dimethyl acetal, and 2,4,6-trimethyl-4-phenyl-1,3-dioxane.

14. The fragrance composition according to claim 3, wherein said fragrance other than 4,8-dimethyl-4,9-decadienenitrile is at least one member selected from the group consisting of 3,3,5-trimethylcyclohexyl ethyl ether, cedryl methyl ether, [3aR-(3aα,5aβ,9aα,9bβ)]dodecahydro-3a,6,6,9a-tetramethyl naphto[2,1-b]furan, dodecahydro-3a,6,6,9a-tetramethylnaphtho[2,1-b]furan, methyl isoeugenol, citronellyl ethyl ether, geranyl ethyl ether, 1,8-cineole, rose oxide, dihydro rose oxide, linalool oxide, estragole, anethole, hinokitiol, diphenyl oxide, β-naphthol methyl ether, β-naphthol ethyl ether, and 1,3,4,6,7,8-hexahydro-4,6,6,7,8,8-hexamethylcyclopenta-γ-2-benzopyran.

15. The fragrance composition according to claim 3, wherein said fragrance other than 4,8-dimethyl-4,9-decadienenitrile is an aliphatic carboxylic acid ester formed by an alcohol and at least one member selected from the group consisting of formic acid, acetic acid, and propionic acid.

16. The fragrance composition according to claim 3, wherein said fragrance other than 4,8-dimethyl-4,9-decadienenitrile is at least one member selected from the group consisting of ethyl dihydrocyclo geranate, ethyl-2-cyclohexyl propionate, ethyl tricyclo[5.2.1.$0^{2,6}$]decan-2-carboxylate, methyl jasmonate, and methyl (2-pentyl-3-oxocyclopentyl)acetate.

17. The fragrance composition according to claim 3, wherein said fragrance other than 4,8-dimethyl-4,9-decadienenitrile is cis-3-hexenyl methyl carbonate.

18. The fragrance composition according to claim 3, wherein said fragrance other than 4,8-dimethyl-4,9-decadienenitrile is at least one member selected from the group consisting of γ-nonalactone, γ-decalactone, δ-decalactone, tetrahydro-6-(3-pentenyl)-2H-pyran-2-one, γ-undecalactone, coumarin, octahydrocoumarin, 6-ethylideneoctahydro-5,8-methano-2H-1-benzopyran-2-one, cyclopentadecanolide, 12(11)-oxacyclohexadecen-2-one, 10-octacycloheptadecen-2-one, and ethylene brassylate.

19. The fragrance composition according to claim 3, wherein said fragrance other than 4,8-dimethyl-4,9-decadienenitrile is at least one member selected from the group consisting of orange oil, lemon oil, lime oil, bergamot, petitgrain, vanilla, mandarin oil, peppermint, spearmint, lavender, chamomile, rosemary, *eucalyptus*, sage, basil, rose, rockrose, geranium, jasmine, ylang ylang, anise, clove, ginger, nutmeg, cardamon, cedar, cypress, vetiver, patchouli, lemongrass, labdanum, *galbanum*, and olibanum.

20. A method of imparting a fragrance to a fragrance composition, a softener composition, a hair cosmetic, or a cleanser composition, said method comprising adding 4,8-dimethyl-4,9-decadienenitrile to said fragrance composition, softener composition, hair cosmetic, or cleanser composition.

* * * * *

UNITED STATES PATENT AND TRADEMARK OFFICE

CERTIFICATE OF CORRECTION

PATENT NO. : 9,200,237 B2
APPLICATION NO. : 14/183923
DATED : December 1, 2015
INVENTOR(S) : Takashi Aoki et al.

It is certified that error appears in the above-identified patent and that said Letters Patent is hereby corrected as shown below:

On the title page, Item (71) and Item (73), the Applicant's and the Assignee's information is incorrect. Item (71) and Item (73) should read:

--(71) Applicant: Kao Corporation, Tokyo, (JP)

(73) Assignee: Kao Corporation, Tokyo, (JP)--

Signed and Sealed this
Twenty-eighth Day of June, 2016

Michelle K. Lee

Michelle K. Lee
*Director of the United States Patent and Trademark Office*